US008939564B2

(12) United States Patent
Igawa

(10) Patent No.: US 8,939,564 B2
(45) Date of Patent: Jan. 27, 2015

(54) DAMPER APPARATUS AND INK JET PRINTER

(71) Applicant: Mimaki Engineering Co., Ltd., Nagano (JP)

(72) Inventor: Tomomi Igawa, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 14/069,398

(22) Filed: Nov. 1, 2013

(65) Prior Publication Data

US 2014/0125745 A1 May 8, 2014

(30) Foreign Application Priority Data

Nov. 7, 2012 (JP) ..... 2012-245856

(51) Int. Cl.
*B41J 2/175* (2006.01)

(52) U.S. Cl.
CPC ..... *B41J 2/17563* (2013.01)
USPC ..... 347/93

(58) Field of Classification Search
CPC .... B41J 2/175; B41J 2/17513; B41J 2/17553; B41J 2/17563
USPC ..... 347/84–86, 93, 94
See application file for complete search history.

(56) References Cited

U.S. PATENT DOCUMENTS 6,986,571 B2 * 1/2006 Dudenhoefer et al. ..... 347/93
7,828,425 B2 * 11/2010 Kang et al. ..... 347/93
8,474,930 B2 * 7/2013 Rasmussen ..... 347/6

FOREIGN PATENT DOCUMENTS

JP 2011-156859 8/2011

* cited by examiner

*Primary Examiner* — An Do
(74) *Attorney, Agent, or Firm* — Jianq Chyun IP Office

(57) ABSTRACT

A sub tank configured to supply ink supplied from a main tank to a print head while suppressing a pressure fluctuation is formed with an ink storage chamber in which the ink is stored, and includes a filter configured to allow passage of the ink while suppressing passage of the fine particles when the fine particles of the ink are precipitated, an ink introducing portion configured to introduce the ink supplied from the outside into the ink storage chamber, and an ink discharging portion configured to discharge the ink in the ink storage chamber to the outside. The filter divides the ink storage chamber into an introducing-side storage chamber communicating with the ink introducing portion, and a discharging-side storage chamber communicating with the ink discharging portion, and the discharging-side storage chamber is arranged on an upper side of the introducing-side storage chamber in the perpendicular direction.

3 Claims, 12 Drawing Sheets

DAMPER APPARATUS AND INK JET PRINTER

CROSS-REFERENCE TO RELATED APPLICATIONS

This application claims the priority benefit of Japan application serial no. 2012-245856, filed on Nov. 7, 2012. The entirety of the above-mentioned patent application is hereby incorporated by reference herein and made a part of this specification.

BACKGROUND OF THE INVENTION

1. Field of the Invention

The present invention relates to a damper apparatus provided in an ink jet printer having a print head configured to eject ink and a tank in which ink to be supplied to the print head is stored and is configured to supply the ink supplied from the tank to the print head while suppressing a pressure fluctuation.

2. Description of the Background Art

Examples of known ink jet printers of the related art include an ink jet printer including an ink jet head as a print head configured to eject ink, a main tank as a tank in which ink to be supplied to the ink jet head is stored, and a sub tank as a damper apparatus configured to supply the ink supplied from the main tank to the ink jet head while suppressing a pressure fluctuation (see JP-A-2011-156859).

The sub tank of this ink jet printer is formed with an ink storage chamber configured to store ink therein. The sub tank also includes a connector portion as an ink introducing portion for introducing ink supplied from the outside into the ink storage chamber and a connector portion as an ink discharging portion for discharging ink in the ink storage chamber to the outside.

The main tank of this ink jet printer is configured to store ink to be introduced into the ink storage chamber of the sub tank via the ink introducing portion of the sub tank.

The ink jet head of this ink jet printer is configured to be supplied with ink discharged from the ink storage chamber of the sub tank via the ink discharging portion of the sub tank.

This ink jet printer includes a first ink flow channel as a normal flow channel, which is a flow channel ranging from the main tank to the ink introducing portion of the sub tank, a third ink flow channel as a circulating flow channel, which is a flow channel ranging from the ink discharging portion of the sub tank to the first ink flow channel, a fluid feeding pump for normal operation as ink supplying device configured to supply ink from the main tank to the ink introducing portion of the sub tank via the first ink flow channel, and a fluid feeding pump for circulation as an ink supplying device configured to supply ink from the ink discharging portion of the sub tank to the ink introducing portion of the sub tank via the third ink flow channel and the first ink flow channel.

This ink jet printer is capable of suppressing precipitating of fine particles of ink such as white ink in the ink storage chamber of the sub tank, the third ink flow channel and the first ink flow channel by circulating the ink among the ink storage chamber of the sub tank, the third ink flow channel, and the first ink flow channel by activating a fluid feeding pump for circulation. Therefore, this ink jet printer is capable of suppressing failures such as printing with ink having low concentration of the fine particles due to precipitating of the fine particles or printing with ink with high concentration of the fine particle due to flashing of precipitated fine particles at a burst.

However, in the ink jet printer of the related art, since a surface area of the ink storage chamber of the sub tank on which ink flows is larger than surface areas of the first ink flow channel and the third ink flow channel on which the ink flows, there is a problem that a flow velocity of ink required for suppressing precipitating of the fine particles of the ink in the ink storage chamber of the sub tank is faster than a flow velocity of the ink required for suppressing precipitating of the fine particles of the ink in the first ink flow channel and the third ink flow channel. Therefore, in the ink jet printer of the related art, when suppressing precipitating of the fine particles of the ink in the ink storage chamber of the sub tank, the flow velocity of ink needs to be faster than that in a case of suppressing only the precipitating of the fine particles of the ink in the first ink flow channel and the third ink flow channel. Therefore, for example, an increase of noise generated by the flow of ink, lowering of durability of the fluid feeding pump for circulation due to an increase of load of the fluid feeding pump for circulation which creates a flow of ink, or an increase of consumed energy by the fluid feeding pump for circulation due to the increase of the load of the fluid feeding pump for circulation may result.

SUMMARY OF THE INVENTION

Accordingly, it is an object of the invention to provide a damper apparatus capable of suppressing precipitating of fine particles of ink at an ink flow velocity slower than that of the related art.

A first aspect of the invention is a damper apparatus provided in an ink jet printer including a print head configured to eject ink and a tank in which the ink to be supplied to the print head is stored, and configured to supply the ink supplied from the tank to the print head while suppressing a pressure fluctuation, including: an ink storage chamber in which the ink is stored; a filter configured to allow passage of the ink therethrough, while suppressing the passage of the fine particles when fine particles of the ink are precipitated; an ink introducing portion configured to introduce the ink supplied from the outside into the ink storage chamber; and an ink discharging portion configured to discharge the ink in the ink storage chamber to the outside, wherein the filter divides the ink storage chamber into an introducing-side storage chamber communicating with the ink introducing portion and a discharging-side storage chamber communicating with the ink discharging portion, and the discharging-side storage chamber is arranged on an upper side of the introducing-side storage chamber in the perpendicular direction.

In this configuration, according to the damper apparatus of the invention, when the pressure of the ink in the introducing-side storage chamber becomes higher than the pressure of the ink in the discharging-side storage chamber due to resistance of the filter which divides the ink storage chamber into the introducing-side storage chamber and the discharging-side storage chamber, with respect to the flow of the ink, the ink flows fast from the introducing-side storage chamber to the discharging-side storage chamber via an entire area of the filter, whereby the fine particles in the ink in the discharging-side storage chamber is raised by the ink flowing from the introducing-side storage chamber to the discharging-side storage chamber via the entire area of the filter. In other words, the damper apparatus of the invention is capable of suppressing precipitating of the fine particles of the ink at a flow velocity of the ink as fast as increasing the pressure of the ink in the introducing-side storage chamber to a level higher than the pressure of the ink in the discharging-side storage chamber by the resistance of the filter. Therefore, the damper apparatus of the invention is capable of suppressing the precipitating of the fine particles of the ink at the flow velocity of the ink slower than that of the related art.

In the damper apparatus of the invention, the discharging-side storage chamber may be overlapped with the filter entirely in the perpendicular direction.

According to the damper apparatus in this configuration, since the fine particles of the ink over the entire area in the discharging-side storage chamber is raised by the ink flowing from the introducing-side storage chamber into the discharging-side storage chamber via the entire area of the filter. Therefore, the precipitating of the fine particles of the ink is adequately suppressed in comparison with a configuration in which at least part of the discharging-side storage chamber is not overlapped with the filter in the perpendicular direction.

In the damper apparatus of the invention, the filter may extend in the horizontal direction.

According to the damper apparatus in this configuration, since the fine particles of the ink in the discharging-side storage chamber is raised in the perpendicular direction by the ink flowing from the introducing-side storage chamber into the discharging-side storage chamber via the entire area of the filter. Therefore, the precipitating of the fine particles of the ink is adequately suppressed in comparison with a configuration in which the filter is inclined with respect to the horizontal direction.

A second aspect of the invention is an ink jet printer including: the damper apparatus described above; the tank in which the ink introduced into the introducing-side storage chamber via the ink introducing portion is stored; the print head to which the ink discharged from the discharging-side storage chamber via the ink discharging portion is supplied; an ink supply device configured to supply the ink to the ink introducing portion; and a normal flow channel, which is a flow channel ranging from the tank to the ink introducing portion; and a circulation flow channel, which is a flow channel ranging from the ink discharging portion to the normal flow channel.

In this configuration, according to the ink jet printer of the invention, since the ink supply device supplies ink from the ink discharging portion of the damper apparatus to the ink introducing portion of the damper apparatus via the circulation flow channel and the normal flow channel, and hence the fine particles of the ink in the discharging-side storage chamber is raised by the ink flowing from the introducing-side storage chamber to the discharging-side storage chamber via the entire area of the filer in the damper apparatus, so that the precipitating of the fine particles of the ink in the damper apparatus is suppressed at the flow velocity of ink slower than that of the related art.

In the ink jet printer of the invention, the ink supply device may increase a flow velocity of the ink in a case where the ink is supplied to the ink introducing portion from the ink discharging portion via the circulation flow channel and the normal flow channel in comparison with a case where the ink is supplied to the ink introducing portion from the tank via the normal flow channel.

In this configuration, since the ink supply device is capable of supplying the ink to the ink introducing portion of the damper apparatus at an ink flow velocity as slow as not increasing the pressure of the ink in the introducing-side storage chamber of the damper apparatus to a level higher than the pressure of the ink in discharging-side storage chamber by resistance of the filter in a case where the ink is supplied to the ink introducing portion of the damper apparatus from the tank via the normal flow channel, the ink jet printer of the invention is capable of reducing a load of the ink supply device in comparison with a configuration in which the ink supply device supplies the ink to the ink introducing portion of the damper apparatus always at the same flow velocity.

The damper apparatus of the invention is capable of suppressing the precipitating of the fine particles of the ink at the flow velocity of the ink slower than that of the related art.

DETAILED DESCRIPTION OF THE INVENTION

Figure 1:
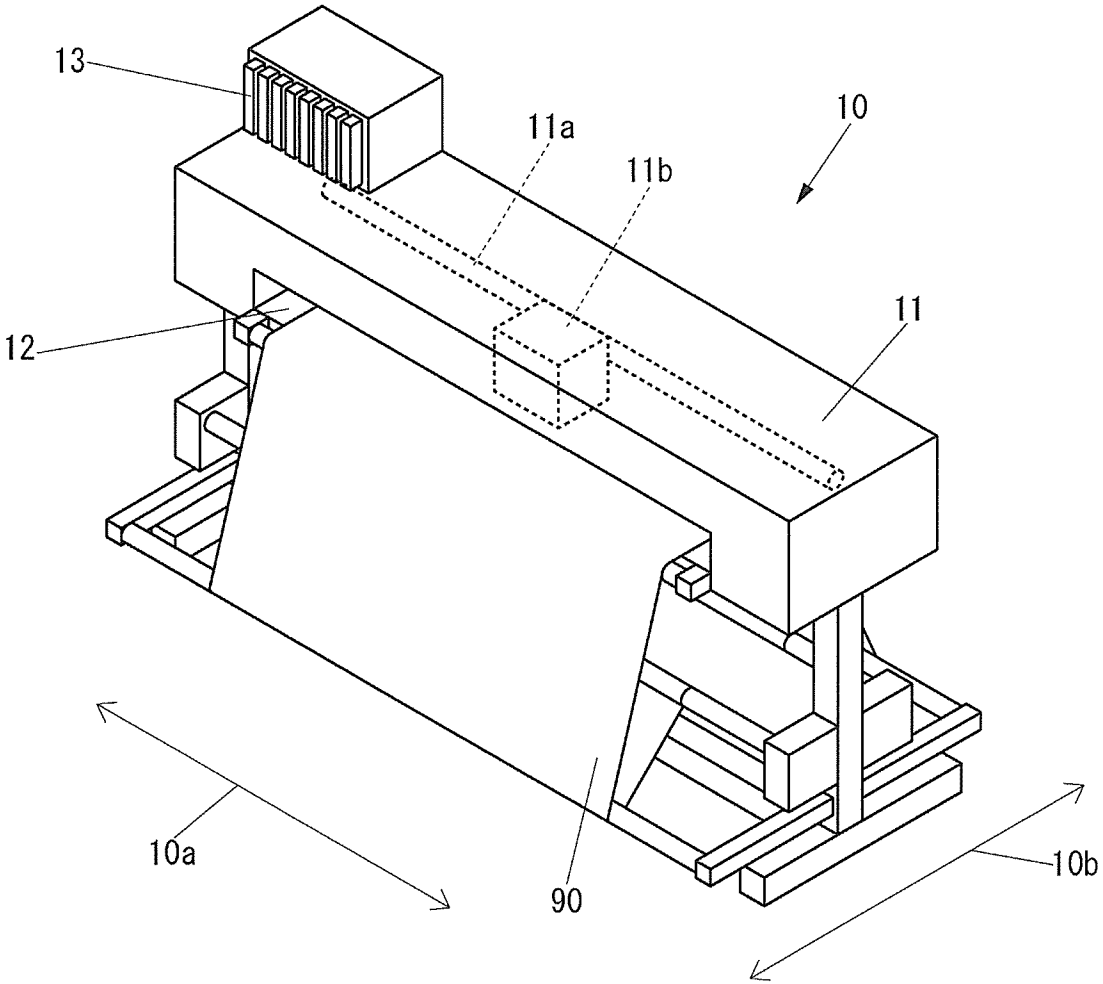
FIG. 1 is a perspective view of an ink jet printer according to a first embodiment of the invention.

Referring now to the drawings, embodiments of the invention will be described.

First Embodiment

First of all, a configuration of an ink jet printer of a first embodiment will be described.

FIG. 1 is a perspective view of an ink jet printer 10 according to the first embodiment.

As illustrated in FIG. 1, the ink jet printer 10 includes a body 11 extending in a primary scanning direction indicated by an arrow 10*a*, a conveying apparatus 12 configured to convey a recording medium 90 such as a sheet, and a main tank 13 as a tank in which ink is stored.

The body 11 includes a guide rail 11*a* extending in the primary scanning direction indicated by the arrow 10*a*, and a carriage 11*b* supported by the guide rail 11*a* so as to be movable in the primary scanning direction indicated by the arrow 10*a*.

The conveying apparatus 12 is an apparatus configured to convey the recording medium 90 in a secondary scanning direction indicated by an arrow 10*b* with respect to a print head 14 described later.

Figure 2:
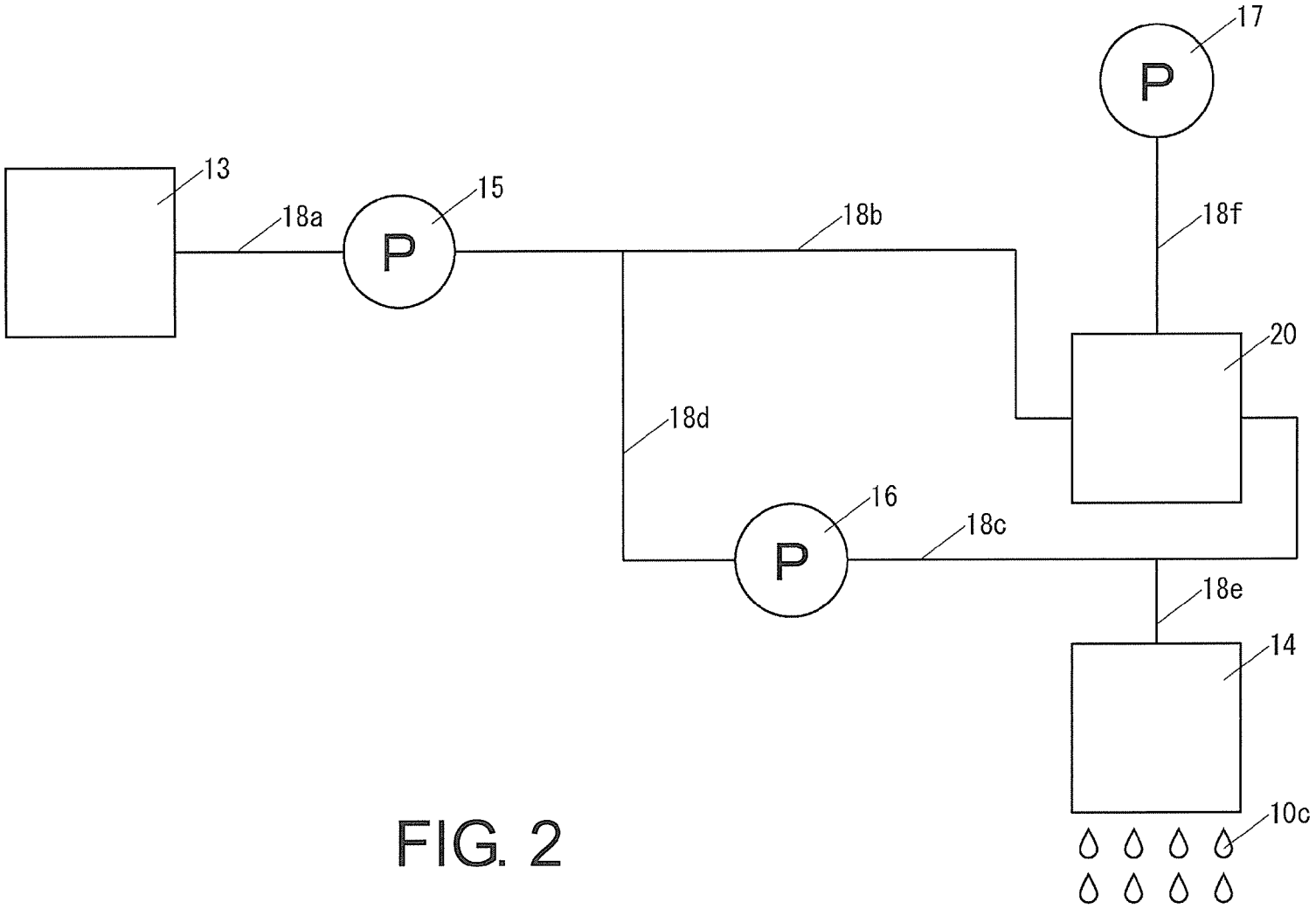
FIG. 2 is a schematic view of an ink supply system of the ink jet printer illustrated in FIG. 1.

FIG. 2 is a schematic view of an ink supply system of the ink jet printer 10.

As illustrated in FIG. 2, the ink supply system of the ink jet printer 10 includes the above-described main tank 13 in which ink 10*c* is stored, the print head 14 configured to discharge the ink 10*c* to the recording medium 90, and a sub tank 20 as a damper apparatus configured to supply the ink 10*c* supplied from the main tank 13 to the print head 14 while suppressing a pressure fluctuation.

The print head 14 and the sub tank 20 are mounted on the carriage 11*b*.

The ink jet printer 10 includes a pump 15 and a pump 16 as ink supply devices configured to supply ink, a pump 17 configured to exhaust air sucked from an air inlet port through an exhaust port, a flow channel 18*a* communicating the main tank 13 and the pump 15, a flow channel 18*b* communicating the pump 15 and the sub tank 20, a flow channel 18*c* communicating the pump 16 and the sub tank 20, a flow channel 18*d* communicating the pump 16 and the flow channel 18*b*, a flow channel 18*e* communicating the print head 14 and the flow channel 18*c*, and a flow channel 18*f* communicating the pump 17 and the sub tank 20.

The pump 15 and the pump 16 are tube pumps.

The flow channel 18*a* and the flow channel 18*b* are flow channels from the main tank 13 to the sub tank 20, and constitute normal flow channels of the invention.

The flow channel 18*c* and the flow channel 18*d* are flow channels from the sub tank 20 to the flow channel 18*b*, and constitute a flow channel for circulation of the invention.

At least parts of the flow channel 18*b*, the flow channel 18*c*, and the flow channel 18*d* are formed of a flexible tube for allowing the print head 14 and the sub tank 20 mounted on the carriage 11*b* to move.

The sub tank 20 is an apparatus configured to suppress a pressure fluctuation generated in the ink 10*c* in the flow channel 18*b* by a deformation of the flow channel 18*b* in association with the movement of the print head 14 and the sub tank 20 mounted on the carriage 11*b*, and supply the ink 10*c* to the print head 14. The sub tank 20 is an apparatus configured to maintain the pressure of the ink 10*c* to be supplied to the print head 14 at a negative pressure within a certain range in order to maintain a meniscus of the ink 10*c* in a nozzle, not illustrated, of the print head 14 in a depressed shape.

The ink jet printer 10 includes an ink supply system illustrated in FIG. 2 for at least each of types of the ink 10*c*. The types of the ink 10*c* are different, for example, by color such as cyan, magenta, yellow, and black.

The ink jet printer 10 illustrated in FIG. 1 is an apparatus configured to cause the print head 14 to execute printing in the primary scanning direction by moving the print head 14 in the primary scanning direction by the carriage 11*b* with respect to the recording medium 90 which does not move in the primary scanning direction indicated by the arrow 10*a* and causing the print head 14 to discharge the ink 10*c* from the nozzle of the print head 14 toward the recording medium 90. The ink jet printer 10 is an apparatus configured to change the position of the print head 14 in the secondary scanning direction with respect to the recording medium 90 every time when printing in the primary scanning direction is terminated by conveying the recording medium 90 in the secondary scanning direction by the conveying apparatus 12 with respect to the print head 14 which does to move in the secondary scanning direction indicated by the arrow 10*b*.

Figure 3:
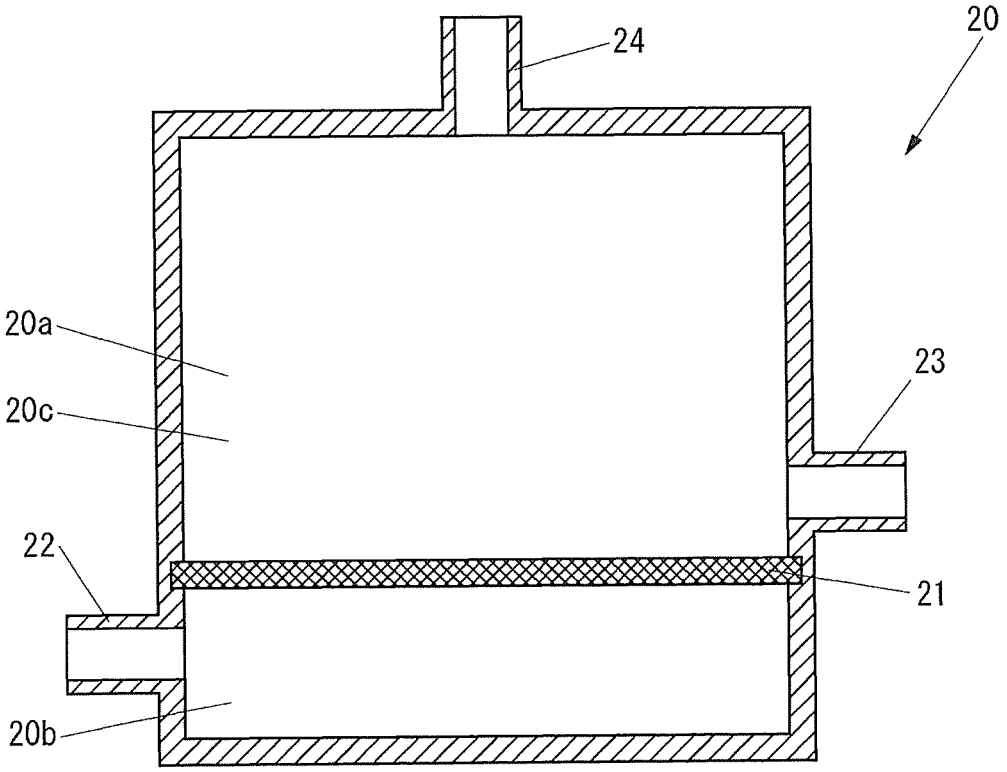
FIG. 3 is a cross-sectional front view of a sub tank illustrated in FIG. 2.
Figure 4:
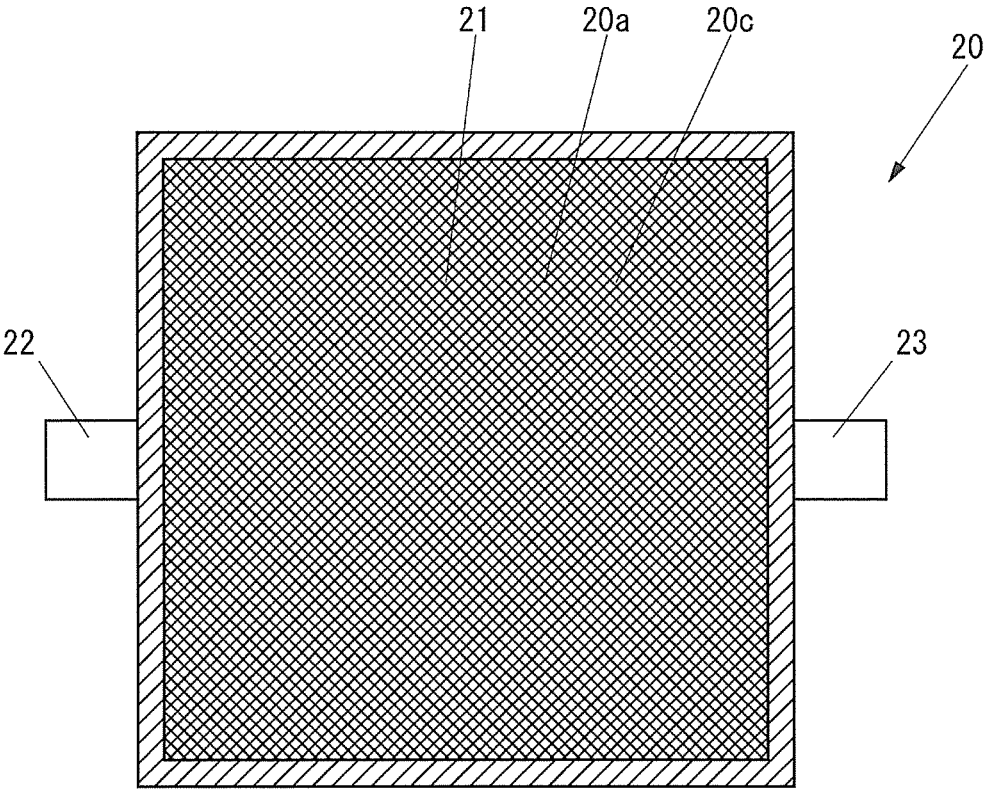
FIG. 4 is a cross-sectional upper view of the sub tank illustrated in FIG. 2.

FIG. 3 is a cross-sectional front view of the sub tank 20. FIG. 4 is a cross-sectional upper view of the sub tank 20.

As illustrated in FIG. 3 and FIG. 4, the sub tank 20 is formed with an ink storage chamber 20*a* in which the ink 10*c* is stored.

The sub tank 20 includes a filter 21 configured to allow passage of the ink 10*c* therethrough on one hand, and suppress the passage of fine particles in a case where the fine particles of the ink 10*c* are precipitated on the other hand, an ink introducing portion 22 configured to introduce the ink 10*c* supplied from the outside into the ink storage chamber 20*a*, an ink discharging portion 23 configured to discharge the ink 10*c* in the ink storage chamber 20*a* to the outside, and an air vent 24 configured to introduce or exhaust air.

The filter 21 divides the ink storage chamber 20*a* into an introducing-side storage chamber 20*b* communicating with the ink introducing portion 22 and a discharging-side storage chamber 20*c* communicating with the ink discharging portion 23. The filter 21 extends in the horizontal direction. The discharging-side storage chamber 20*c* is arranged on an upper side of the introducing-side storage chamber 20*b* in the perpendicular direction. The discharging-side storage chamber 20*c* is overlapped with the filter 21 entirely in the perpendicular direction.

The ink introducing portion 22 communicates with the flow channel 18*b*.

The ink discharging portion 23 communicates with the flow channel 18*c*.

The air vent 24 communicates with the flow channel 18*f*. The air vent 24 communicates with the discharging-side storage chamber 20*c*.

Figure 5:
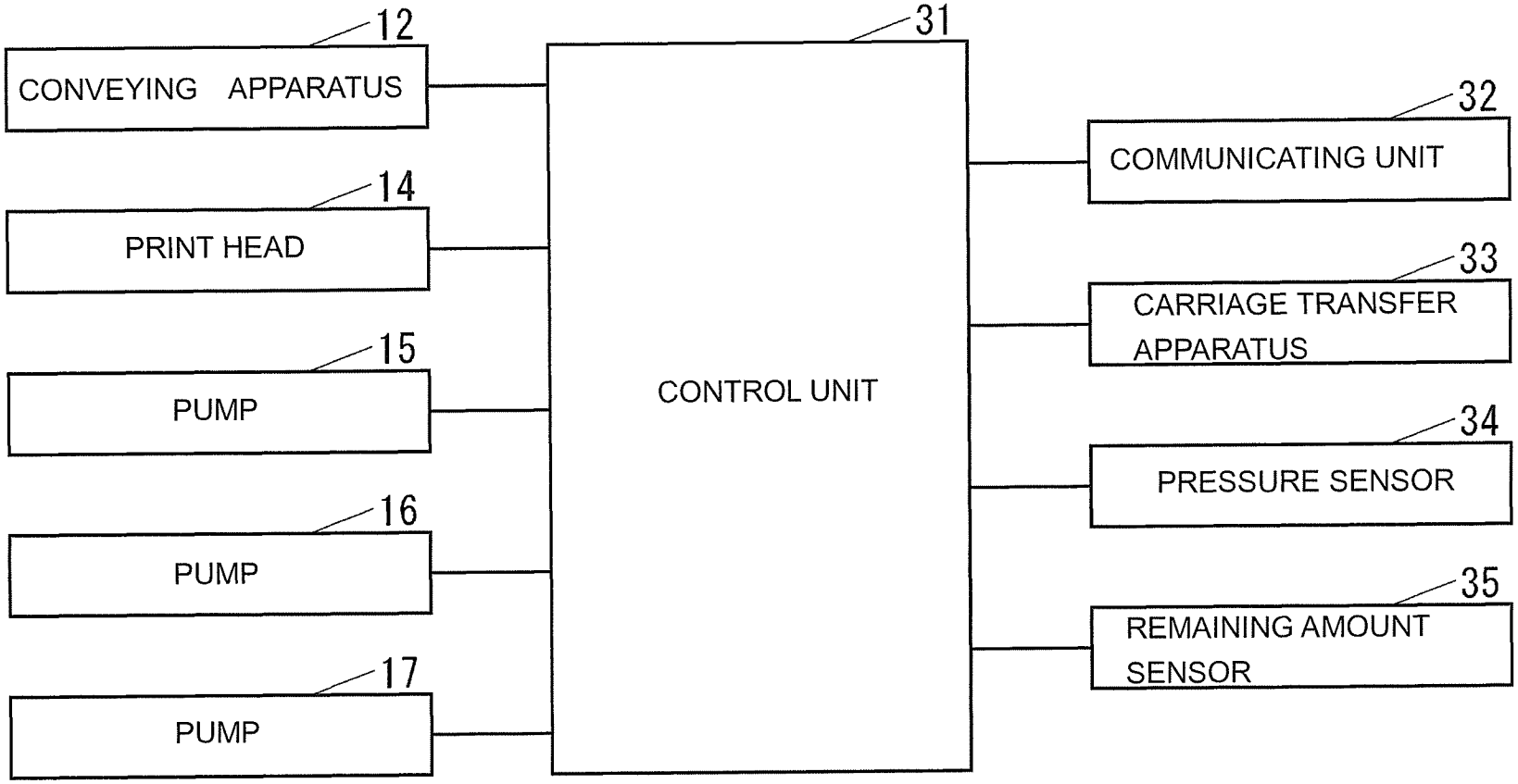
FIG. 5 is a block diagram illustrating a configuration of a control system of the ink jet printer illustrated in FIG. 1.

FIG. 5 is a block diagram illustrating a configuration of a control system of the ink jet printer 10.

As illustrated in FIG. 5, the ink jet printer 10 includes the conveying apparatus 12, the print head 14, the pump 15, the pump 16 and the pump 17, a control unit 31 configured to control the entire inkjet printer 10, a communicating unit 32 configured to communicate with an external apparatus such as a PC (Personal Computer), a carriage transfer apparatus 33 configured to move the carriage 11*b* in the primary scanning direction indicated by the arrow 10*a*, a pressure sensor 34 configured to detect a pressure of air in the flow channel 18*f*, and a remaining amount sensor 35 configured to detect the remaining amount of the ink 10*c* in the ink storage chamber 20*a* of the sub tank 20.

The control unit 31 includes a CPU (Central Processing Unit), a ROM (Read Only Memory) in which a program and various data are stored in advance, and a RAM (Random Access memory) used as a working area of the CPU. The CPU is configured to execute the program stored in the ROM.

Subsequently, an operation of the inkjet printer 10 will be described.

First of all, an operation of the ink jet printer 10 during the normal operation will be described.

The control unit 31 of the ink jet printer 10 stops a flow of the ink 10*c* in the flow channel 18*d* by the pump 16 during the normal operation.

When the control unit 31 receives printing data via the communicating unit 32 from the external apparatus, the control unit 31 drives the conveying apparatus 12 and the carriage transfer apparatus 33 and changes the position of the print head 14 with respect to the recording medium 90 on the basis of the received printing data, and discharges the ink 10*c* toward the recording medium 90 by the print head 14. When the ink 10*c* is discharged by the print head 14, a volume of the ink 10*c* in the print head 14 is reduced, and hence new ink 10*c* is supplied from the discharging-side storage chamber 20*c* of the sub tank 20 to the print head 14 via the ink discharging portion 23, the flow channel 18*c* and the flow channel 18*e* by an amount corresponding to a reduced amount of the ink 10*c* in the print head 14.

Here, the control unit 31 maintains the pressure of air in the flow channel 18*f* at a negative pressure within a certain range by driving the pump 17 on the basis of an output from the pressure sensor 34 during the normal operation. Here, the flow channel 18*f* communicates with the discharging-side storage chamber 20*c* of the sub tank 20 via the air vent 24 of the sub tank 20. Then, the ink 10*c* in the discharging-side storage chamber 20*c* of the sub tank 20 is supplied to the print head 14 via the ink discharging portion 23 of the sub tank 20, the flow channel 18*c*, and the flow channel 18*e*. Therefore, the sub tank 20 maintains the pressure of the ink 10*c* to be supplied to the print head 14 at a negative pressure.

Figure 6:
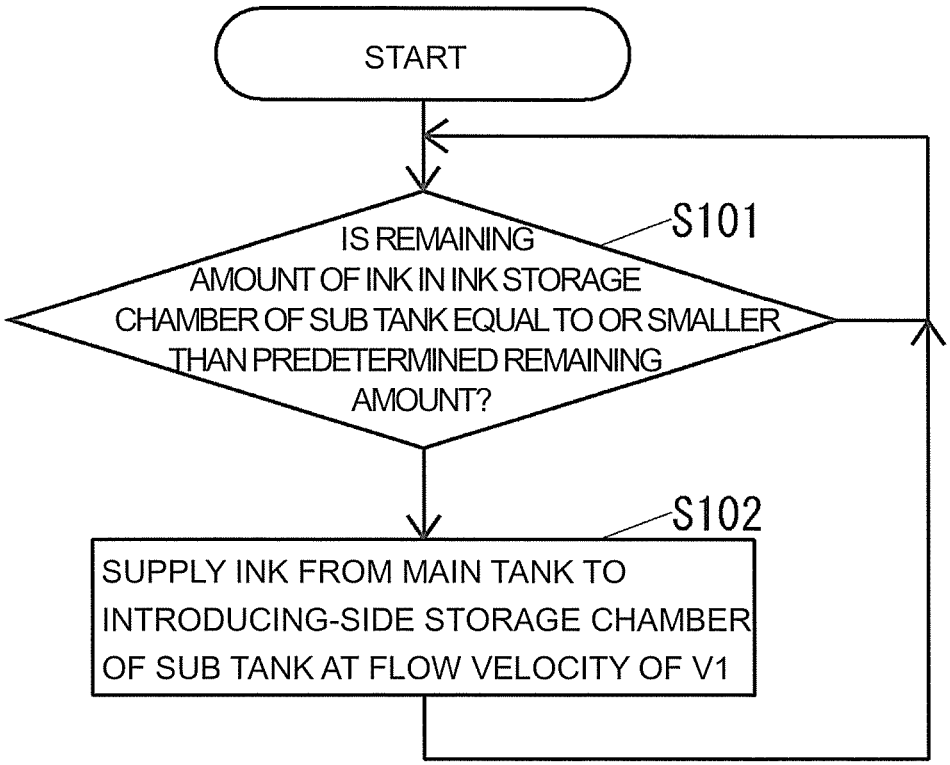
FIG. 6 is a flowchart of an operation of a control unit illustrated in FIG. 5 when circulating ink by a pump during a normal operation.

The control unit 31 executes an operation illustrated in FIG. 6 on the basis of an output of the remaining amount sensor 35 during the normal operation.

FIG. 6 is a flowchart of an operation of the control unit 31 in a case where the ink 10*c* is circulated by the pump 15 during the normal operation.

As illustrated in FIG. 6, the control unit 31 determines whether or not the remaining amount of the ink 10*c* in the ink storage chamber 20*a* of the sub tank 20 is equal to or smaller than a predetermined remaining amount (S101) on the basis of the output from the remaining amount sensor 35.

When the control unit 31 determines that the remaining amount of the ink 10*c* in the ink storage chamber 20*a* is not equal to or smaller than the predetermined remaining amount in S101, the procedure goes back again to the process of S101.

In contrast, when the control unit 31 determines that the remaining amount of the ink 10*c* in the ink storage chamber 20*a* is equal to or smaller than the predetermined remaining amount in S101, the control unit 31 activates the pump 15 to supply the ink 10*c* stored in the main tank 13 to the introducing-side storage chamber 20*b* of the sub tank 20 at a flow velocity V1 via the flow channel 18*a*, the flow channel 18*b*, and the ink introducing portion 22 of the sub tank 20 (S102), and the procedure returns to the process of S101 again.

Figure 7:
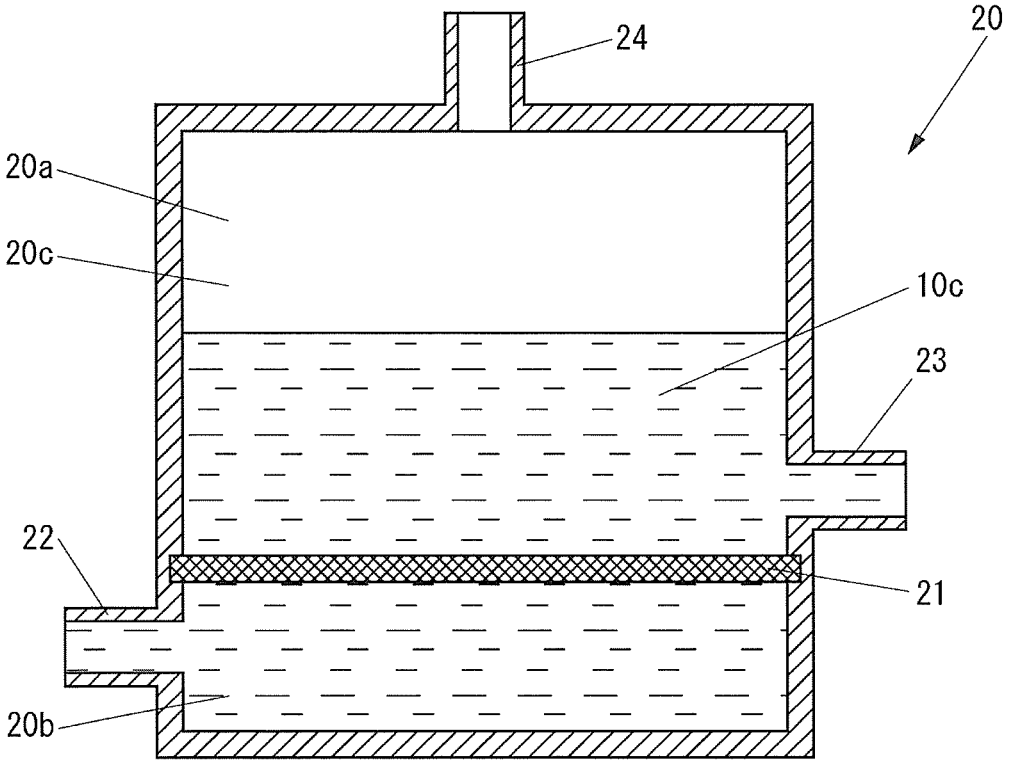
FIG. 7 is a cross-sectional front view of the sub tank illustrated in FIG. 2 during the normal operation.

FIG. 7 is a cross-sectional front view of the sub tank 20 during the normal operation.

When the ink 10*c* is supplied to the introducing-side storage chamber 20*b* of the sub tank 20 via the ink introducing portion 22 of the sub tank 20, the ink 10*c* in the introducing-side storage chamber 20*b* moves to the discharging-side storage chamber 20*c* via the filter 21 by an amount corresponding to a volume of the ink 10*c* introduced to the introducing-side storage chamber 20*b* via the ink introducing portion 22. Therefore, the discharging-side storage chamber 20*c* of the sub tank 20 is maintained in a state in which the ink 10*c* of an amount equal to or larger than a certain amount is always stored therein as illustrated in FIG. 7.

Subsequently, an operation of the ink jet printer 10 during the circulating operation will be described.

The control unit 31 of the ink jet printer 10 stops the flow of the ink 10*c* in the flow channel 18*a* by the pump 15 during the circulating operation.

Figure 8:
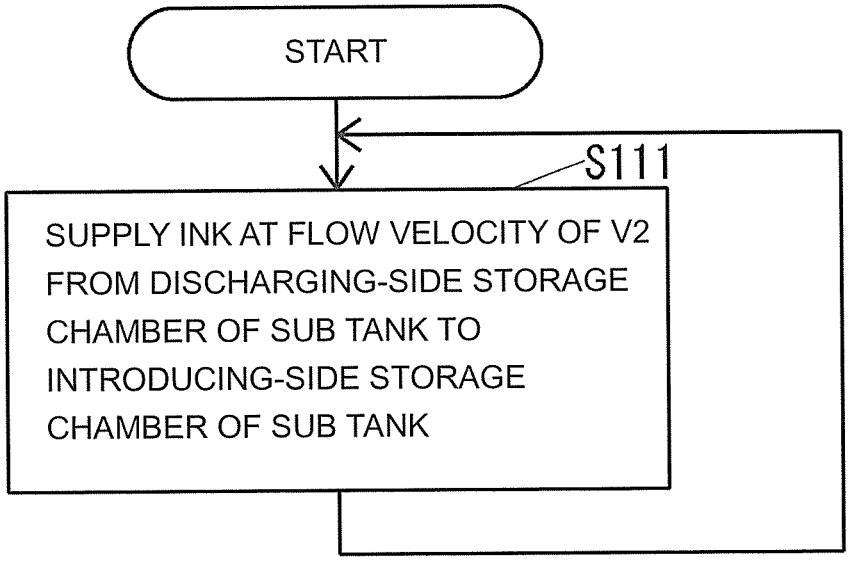
FIG. 8 is a flowchart of an operation of the control unit illustrated in FIG. 5 in a case of circulating ink by a pump during a circulating operation.

FIG. 8 is a flowchart of an operation of the control unit 31 in a case where the ink 10*c* is circulated by the pump 16 during the circulating operation.

As illustrated in FIG. 8, the control unit 31 activates the pump 16 to continuously supply the ink 10*c* stored in the discharging-side storage chamber 20*c* of the sub tank 20 to the introducing-side storage chamber 20*b* of the sub tank 20 at a flow velocity V2 via the ink discharging portion 23 of the sub tank 20, the flow channel 18*c*, the flow channel 18*d*, the flow channel 18*b*, and the ink introducing portion 22 of the sub tank 20 (S111).

Here, the flow velocity V2 is faster than the flow velocity V1. In other words, the pump 15 and the pump 16 are configured to increase the flow velocity of the link 10*c* in a case where the pump 16 supplies the ink 10*c* from the ink discharging portion 23 of the sub tank 20 to the ink introducing portion 22 of the sub tank 20 via the flow channel for circulation and the normal flow channel in comparison with a case where the pump 15 supplies the ink 10*c* to the ink introducing portion 22 of the sub tank 20 from the main tank 13 via the normal flow channel.

Figure 9A:
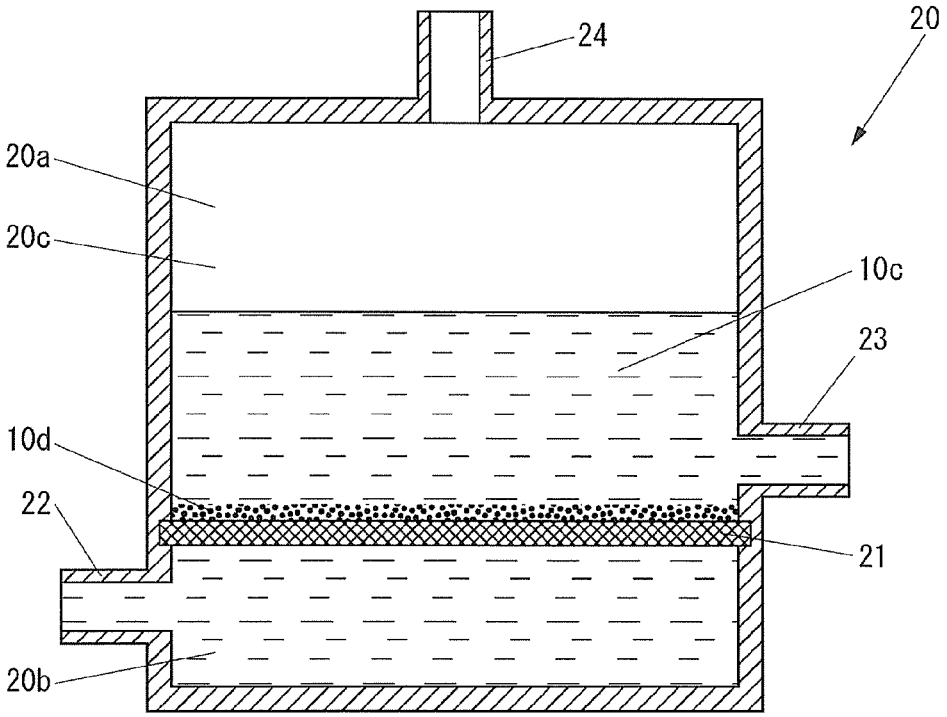
FIG. 9A is a cross-sectional front view of the sub tank illustrated in FIG. 2 before the circulating operation.
Figure 9B:
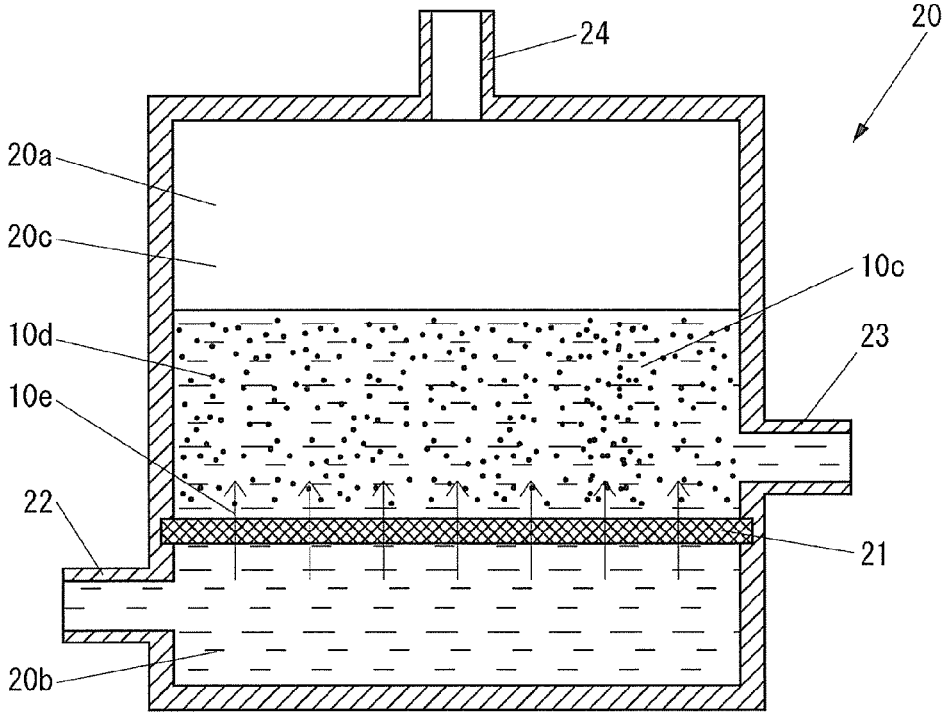
FIG. 9B is a cross-sectional front view of the sub tank illustrated in FIG. 2 during the circulating operation.

FIG. 9A is a cross-sectional front view of the sub tank 20 before the circulating operation. FIG. 9B is a cross-sectional front view of the sub tank 20 during the circulating operation.

When the ink 10*c* is supplied to the introducing-side storage chamber 20*b* of the sub tank 20 via the ink introducing portion 22 of the sub tank 20, the ink 10*c* in the introducing-side storage chamber 20*b* moves to the discharging-side storage chamber 20*c* via the filter 21 by an amount corresponding to a volume of the ink 10*c* introduced to the introducing-side storage chamber 20*b* via the ink introducing portion 22. Therefore, fine particles 10*d* of the ink 10*c* precipitated on the filter 21 of the sub tank 20 before the circulating operation as illustrated in FIG. 9A are raised by the ink 10*c* flowing from the introducing-side storage chamber 20*b* to the discharging-side storage chamber 20*c* via the entire area of the filter 21 as illustrated in FIG. 9B by the circulating operation. In FIG. 9B, the arrow 10*e* indicates the flow of the ink 10*c* flowing from the introducing-side storage chamber 20*b* to the discharging-side storage chamber 20*c* via the entire area of the filter 21.

The precipitating of the fine particles 10*d* of the ink 10*c* is suppressed not only in the sub tank 20, but also in a portion of the flow channel 18*b* from a position communicating with the flow channel 18*d* to the sub tank 20 and in the flow channel 18*c* and the flow channel 18*d* by the flow of the ink 10*c* by the circulating operation.

As described thus far, in the sub tank 20, when the pressure of the ink 10*c* in the introducing-side storage chamber 20*b* becomes higher than the pressure of the ink 10*c* in the discharging-side storage chamber 20*c* due to resistance of the filter 21 which divides the ink storage chamber 20*a* into the introducing-side storage chamber 20*b* and the discharging-side storage chamber 20*c*, with respect to the flow of the ink 10*c*, as illustrated in FIG. 9B, the ink 10*c* flows fast from the introducing-side storage chamber 20*b* to the discharging-side storage chamber 20*c* via the entire area of the filter 21, whereby the fine particles 10*d* in the ink 10*c* in the discharging-side storage chamber 20*c* is raised by the ink 10*c* flowing from the introducing-side storage chamber 20*b* to the discharging-side storage chamber 20*c* via the entire area of the filter 21. In other words, the sub tank 20 is capable of suppressing the precipitating of the fine particles 10*d* of the ink 10*c* at the flow velocity V2 of the ink 10*c* as fast as increasing the pressure of the ink 10*c* in the introducing-side storage chamber 20*b* to *a* level higher than the pressure of the ink 10*c* in the discharging-side storage chamber 20*c* by the resistance of the filter 21. Therefore, the sub tank 20 is capable of suppressing the precipitating of the fine particles 10*d* of the ink 10*c* at the flow velocity V2 of the ink 10*c* slower than that of the related art.

Since the sub tank 20 has a configuration described above, the ink jet printer 10 is capable of suppressing the precipitating of the fine particles 10*d* of the ink 10*c* in the sub tank 20 at the flow velocity V2 which is slower than that in the related art by supplying the ink 10*c* from the ink discharging portion 23 of the sub tank 20 to the ink introducing portion 22 of the sub tank 20 via the flow channel for circulation and the flow channel of the normal operation by the pump 16.

Figure 10:
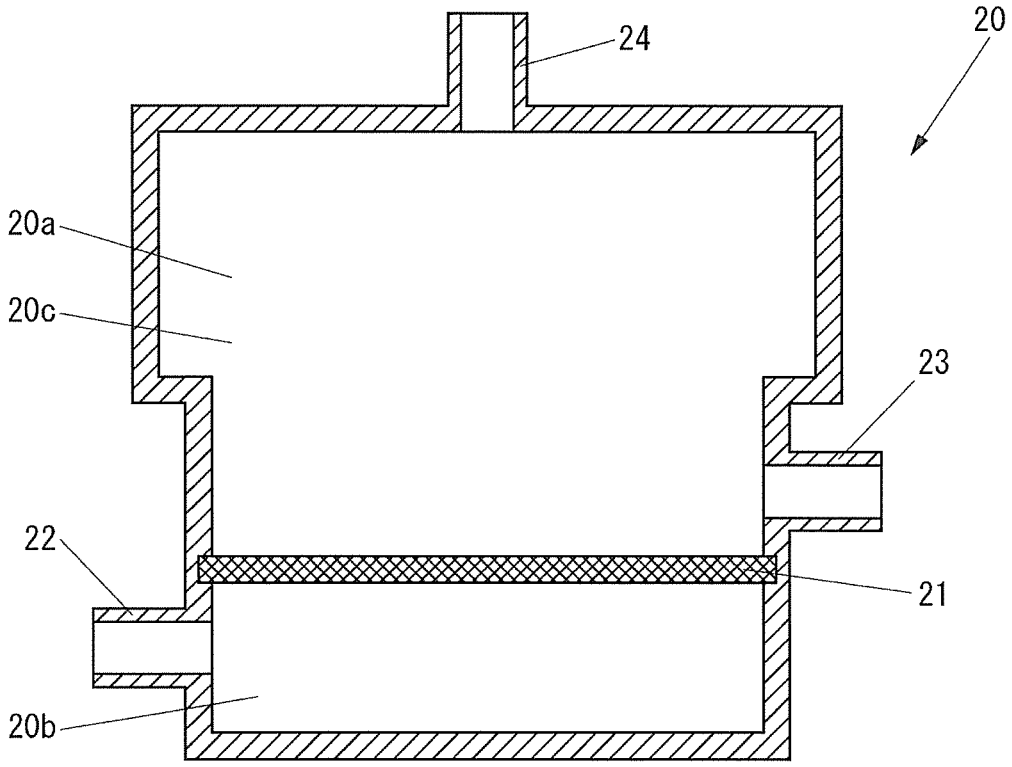
FIG. 10 is a cross-sectional front view of the sub tank illustrated in FIG. 2 illustrating an example different from that illustrated in FIG. 3.

FIG. 10 is a cross-sectional front view of the sub tank 20 and is a drawing illustrating an example different from the example illustrated in FIG. 3.

The discharging-side storage chamber 20*c* of the sub tank 20 illustrated in FIG. 3 and FIG. 4 is overlapped with the filter 21 entirely in the perpendicular direction. Therefore, the fine particles 10*d* of the ink 10*c* over the entire area in the discharging-side storage chamber 20*c* is raised by the ink 10*c* flowed from the introducing-side storage chamber 20*b* to the discharging-side storage chamber 20*c* via the entire area of the filter 21. Therefore, the sub tank 20 illustrated in FIG. 3 and FIG. 4 is capable of suppressing the precipitating of the fine particles 10*d* of the ink 10*c* adequately in comparison with the configuration in which at least part of the discharging-side storage chamber 20*c* is not overlapped with the filter 21 in the perpendicular direction as illustrated in FIG. 10. The sub tank 20 may have a configuration in which at least a part of the discharging-side storage chamber 20*c* is not overlapped with the filter 21 in the perpendicular direction as illustrated in FIG. 10.

Figure 11:
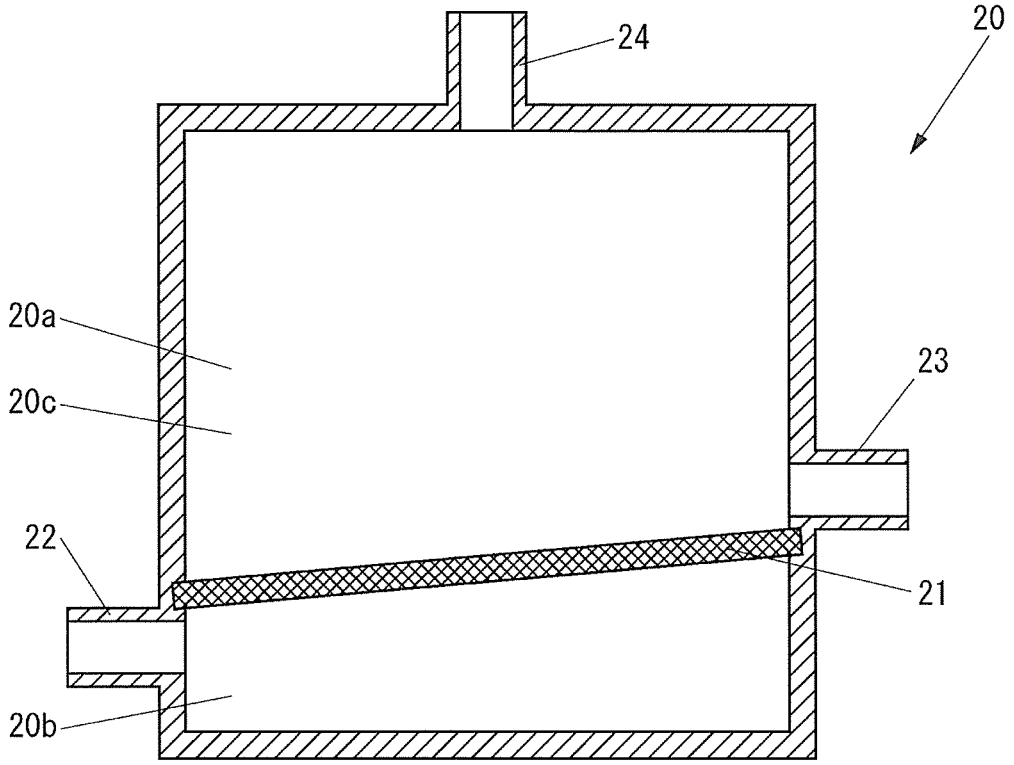
FIG. 11 is a cross-sectional front view of the sub tank illustrated in FIG. 2 illustrating an example different from those illustrated in FIG. 3 and FIG. 10.

FIG. 11 is a cross-sectional front view of the sub tank 20 and is a drawing illustrating an example different from the examples illustrated in FIG. 3 and FIG. 10.

The filter 21 of the sub tank 20 illustrated in FIG. 3 extends in the horizontal direction. Therefore, the fine particles 10*d* of the ink 10*c* in the discharging-side storage chamber 20*c* is raised in the perpendicular direction by the ink 10*c* flowed from the introducing-side storage chamber 20*b* to the discharging-side storage chamber 20*c* via the entire area of the filter 21. Therefore, the sub tank 20 illustrated in FIG. 3 is capable of suppressing the precipitating of the fine particles 10*d* of the ink 10*c* adequately in comparison with the configuration in which the filter 21 is inclined with respect to the horizontal direction as illustrated in FIG. 11. The sub tank 20 may have a configuration in which the filter 21 is inclined with respect to the horizontal direction as illustrated in FIG. 11.

The ink jet printer 10 is configured to increase the flow velocity of the link 10*c* in a case where the pump 16 supplies the ink 10*c* from the ink discharging portion 23 of the sub tank 20 to the ink introducing unit 22 of the sub tank 20 via the flow channel for circulation and the normal flow channel in comparison with a case where the pump 15 supplies the ink 10*c* to the ink introducing portion 22 of the sub tank 20 from the main tank 13 via the normal flow channel. In this configuration, in a case where the pump 15 supplies the ink 10*c* to the ink introducing portion 22 of the sub tank 20 from the main tank 13 via the normal flow channel, the ink jet printer 10 is capable of supplying the ink 10*c* to the ink introducing portion 22 of the sub tank 20 at the flow velocity V1 of the ink 10*c* as slow as not increasing the pressure of the ink 10*c* in the introducing-side storage chamber 20*b* of the sub tank 20 to a level higher than the pressure of the ink 10*c* in the discharging-side storage chamber 20*c* by the resistance of the filter 21. Therefore, the ink jet printer 10 is capable of reducing the load of the pump 15 in comparison with the configuration in which the pumps 15 and 16 supply the ink 10*c* to the ink introducing portion 22 of the sub tank 20 always at the same flow velocity.

Second Embodiment

First of all, a configuration of an ink jet printer of a second embodiment will be described.

Configurations of the ink jet printer of the second embodiment which are the same as the configurations of the ink jet printer 10 (see FIG. 1) according to the first embodiment are denoted by the same reference numerals as the configurations of the ink jet printer 10, and detailed description thereof will be omitted.

Figure 12:
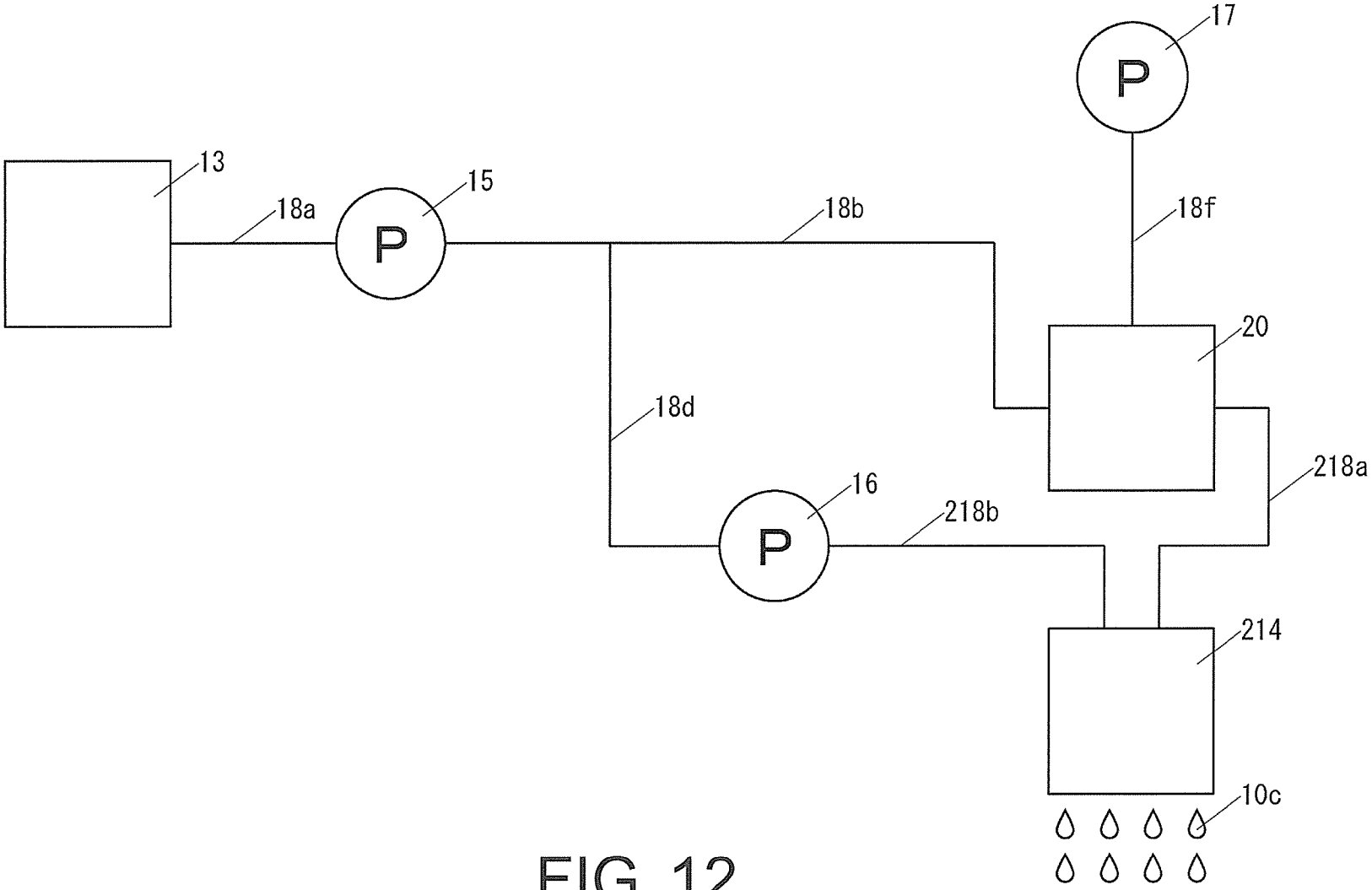
FIG. 12 is a schematic view of an ink supply system of an ink jet printer according to a second embodiment of the invention.

FIG. 12 is a schematic view of the ink supply system of the ink jet printer according to the second embodiment.

As illustrated in FIG. 12, the configuration of the ink jet printer according to the second embodiment is the same as a configuration of the ink jet printer 10 (see FIG. 1) including a print head 214 configured to eject the ink 10*c* on the recording medium 90, a flow channel 218*a* communicating the print head 214 and the sub tank 20, a flow channel 218*b* communicating the print head 214 and the pump 16 instead of the print head 14 (see FIG. 2), the flow channel 18*c* (see FIG. 2), and the flow channel 18*e* (see FIG. 2).

The print head 214 and the sub tank 20 are mounted on the carriage 11*b*.

The flow channel 218*a* communicates with the ink discharging portion 23 of the sub tank 20.

The flow channel 218*a*, the flow channel 218*b*, and the flow channel 18*d* are flow channels from the sub tank 20 to the flow channel 18*b*, and constitute flow channels of circulation of the invention.

At least parts of the flow channel 18*b*, the flow channel 218*b*, and the flow channel 18*d* are a flexible tube for allowing the print head 214 and the sub tank 20 mounted on the carriage 11*b* to move.

Subsequently, an operation of the ink jet printer of the second embodiment will be described.

First of all, an operation of the ink jet printer according to the second embodiment during the normal operation will be described.

The operation of the ink jet printer according to the second embodiment during the normal operation is the same as the operation of the ink jet printer 10 according to the first embodiment during the normal operation except for that new ink 10*c* is not supplied to the print head 14 from the discharging-side storage chamber 20*c* of the sub tank 20 via the ink discharging portion 23, the flow channel 18*c* and the flow channel 18*e*, but new ink 10*c* is supplied to the print head 214 from the discharging-side storage chamber 20*c* of the sub tank 20 via the ink discharging portion 23 and the flow channel 218*a*.

Subsequently, an operation of the ink jet printer 10 during the circulating operation will be described.

The operation of the ink jet printer according to the second embodiment during the circulating operation is the same as the operation of the ink jet printer 10 according to the first embodiment during the circulating operation except that the ink 10*c* stored in the discharging-side storage chamber 20*c* of the sub tank 20 is not supplied to the introducing-side storage chamber 20*b* of the sub tank 20 via the ink discharging portion 23 of the sub tank 20, the flow channel 18*c*, the flow channel 18*d*, the flow channel 18*b*, and the ink introducing portion 22 of the sub tank 20, but the ink 10*c* stored in the discharging-side storage chamber 20*c* of the sub tank 20 is supplied to the introducing-side storage chamber 20*b* of the sub tank 20 via the ink discharging portion 23 of the sub tank 20, the flow channel 218*a*, the print head 214, the flow channel 218*b*, the flow channel 18*d*, the flow channel 18*b*, and the ink introducing portion 22 of the sub tank 20.

The ink jet printer according to the second embodiment has a new advantageous effect that precipitating of the ink 10*c* in the print head 214 can be suppressed during the circulating operation in addition to an advantageous effect of the ink jet printer 10 according to the first embodiment.

In the respective embodiments described above, the pumps are separately used in a case where the ink 10*c* is supplied from the main tank 13 to the ink introducing portion 22 of the sub tank 20 via the normal flow channel and a case where the ink 10*c* is supplied from the ink discharging portion 23 of the sub tank 20 to the ink introducing portion 22 of the sub tank 20 via the flow channel for circulation and the normal flow channel. However, the ink 10*c* may be supplied by the same pump.

What is claimed is:

1. An ink jet printer comprising:

a print head configured to eject ink;

a tank in which the ink to be supplied to the print head is stored;

a damper apparatus configured to supply the ink supplied from the tank to the print head while suppressing a pressure fluctuation, comprising:

an ink storage chamber in which the ink is stored;

a filter configured to allow passage of the ink therethrough while suppressing the passage of the fine particles when the fine particles of the ink are precipitated;

an ink introducing portion configured to introduce the ink supplied from an outside into the ink storage chamber; and an ink discharging portion configured to discharge the ink in the ink storage chamber to the outside, wherein the filter divides the ink storage chamber into an introducing-side storage chamber communicating with the ink introducing portion and a discharging-side storage chamber communicating with the ink discharging portion, and the discharging-side storage chamber is arranged on an upper side of the introducing-side storage chamber in a perpendicular direction, the tank in which the ink introduced into the introducing-side storage chamber via the ink introducing portion is stored;

the print head to which the ink discharged from the discharging-side storage chamber via the ink discharging portion is supplied;

an ink supply device configured to supply the ink to the ink introducing portion; and a normal flow channel, which is a flow channel ranging from the tank to the ink introducing portion; and a circulation flow channel, which is a flow channel ranging from the ink discharging portion to the normal flow channel, wherein the ink supply device increases a flow velocity of the ink in a case where the ink is supplied to the ink introducing portion from the ink discharging portion via the circulation flow channel and the normal flow channel in comparison with a case where the ink is supplied to the ink introducing portion from the tank via the normal flow channel.

2. The ink jet printer according to claim 1, wherein the discharging-side storage chamber is overlapped with the filter entirely in the perpendicular direction.

3. The ink jet printer according to claim 1, wherein the filter extends in a horizontal direction.

* * * * *